US005786757A

United States Patent [19]

Right et al.

[11] Patent Number: 5,786,757

[45] Date of Patent: Jul. 28, 1998

[54] LOAD SHED SCHEME FOR TWO WIRE DATA TRANSMISSION

[75] Inventors: Robert W. Right, Huntington, Conn.; Hilario S. Costa, Sarasota; Jan A. Braam, Bradenton, both of Fla.

[73] Assignee: General Signal Corporation, Stamford, Conn.

[21] Appl. No.: 441,762

[22] Filed: May 16, 1995

[51] Int. Cl.[6] ..... G08B 1/00

[52] U.S. Cl. ..... 340/531; 340/506; 340/517; 340/519; 340/520; 340/825.06

[58] Field of Search ..... 340/501, 506, 340/508, 511, 517, 519, 520, 521, 522, 523, 825.06, 825.05

[56] References Cited

U.S. PATENT DOCUMENTS

| | | | |
|---|---|---|---|
| 4,535,321 | 8/1985 | Merz | 340/520 |
| 4,901,316 | 2/1990 | Igarashi et al. | 371/37.1 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |
| 5,486,811 | 1/1996 | Wehrle et al. | 340/522 |

FOREIGN PATENT DOCUMENTS

| | | |
|---|---|---|
| 485878 A2 | 5/1992 | European Pat. Off. . |
| 3128777 A1 | 2/1983 | Germany . |
| 3128788 A1 | 2/1983 | Germany . |
| 3128796 A1 | 2/1983 | Germany . |
| 3128811 A1 | 2/1983 | Germany . |
| 3415819 A1 | 10/1985 | Germany . |
| 4027656 A1 | 3/1992 | Germany . |

*Primary Examiner*—Thomas Mullen
*Assistant Examiner*—Daryl C. Pope
*Attorney, Agent, or Firm*—Ohlandt, Greeley, Rugiero & Perle

[57] ABSTRACT

An alarm system for detecting and warning of the presence of alarm and trouble conditions in transponders located in a plurality of zones consisting of a loop controller having a plurality of input signal and power supply lines connected to the respective transponder units, and having a plurality of initiating and indicating devices in a respective plurality of circuits. Further, the system has a module, including a microcontroller, connected in each of the transponder units to the plurality of input lines and to the plurality of circuits, the module being capable of initiating communication of the conditions of the circuits to the loop controller. Moreover, it includes a plurality of smoke detectors, which are connected in the circuits and to respective modules. A load shed arrangement is provided for sensing the alarm conditions of the smoke detectors and reporting their conditions to the loop controller. It also permits, in the first instance, a first of the smoke detectors to draw operating current, but, thereafter, precludes the others of the plurality of smoke detectors from drawing their operating current.

4 Claims, 10 Drawing Sheets

LOAD SHED SCHEME FOR TWO WIRE DATA TRANSMISSION

The present invention relates to a load shed scheme for two wire data transmission in a fire alarm and detection system. The invention of this application is related to inventions described in four other applications with reference to the same fire alarm and detection system: docket 100.0600 "Field Programmable Module Personalities", docket 100.0601 "Ground Fault Detection With Location Identification", docket 100.0602 "Line Monitor for Two Wire Data Transmission" and docket 100.0603 "Stand Alone Mode For Alarm-Type Module".

BACKGROUND AND OBJECTS OF THE INVENTION

The present invention is in the field of fire alarm and detection. Early examples of prior systems of this general type may be appreciated by reference to following U.S. Pat. Nos. 4,568,919, 4,752,698, 4,850,018, 4,954,809, 4,962,368.

Most of the above cited U.S. patents describe systems that are approximately six to ten years old, and in most of these systems the loop controller, or the like, initiates the determination of the states of the units at the various zones or stations in the system by the use of a repetitive polling scheme for polling the detector units or stations from the loop controller, whereby addresses are sent successively on the loop or lines to determine which, if any, units are in an alarm state. Provision is also made in most of these systems to detect trouble conditions in the system.

Other fire detector and alarm systems have been developed in the recent past, that is, in the past five years or so, that provide a variety of features, including the feature of an intelligent transponder, combined with an integral processor such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; twisted or shielded wire is not required.

Whatever the advantages and benefits of prior art systems, they fail to provide a means for shedding load from the system in the situation where conventional smoke detectors are deployed, such detectors drawing relatively large currents of the order of 20 milliamps. The result is that the system becomes overloaded and its alarm indicating purposes are frustrated.

Accordingly, it is a primary object of the present invention to provide a load shed scheme that will selectively permit an initial alarm from a first conventional smoke detector to perform its indicating function, but to preclude current overload on the system.

A further object is to enable transmission of the initial alarm from the first detector to the controller and to maintain an alarm indication at a unit by an LED or the like, blocking the normal action of other smoke detectors so as to conserve power.

SUMMARY OF THE INVENTION

Before launching into the summary of the invention, it is well to consider certain definitions:

a module when referred to hereinafter is an electronic circuit that is interconnected over the same wire pair as, for example, smoke detectors. Thus, in the system which forms the context of the present invention modules have been incorporated in each of the transponder units located at various zones or stations of the system, and these modules are connected over the same wire pair as the smoke detectors or other sensing devices at the given unit or station. Smoke detectors monitor particles of combustion while the modules themselves monitor external contact closure activity in connection with the outbreak of fire or the like, the closure activity resulting from the response of smoke detectors, and also such as the following: heat detectors, fire alarm pull stations, door closures, fan shutdown, etc.

To accomplish the foregoing objects and advantages, the present invention, in brief summary, is an alarm system for detecting and warning of the presence of alarm and trouble conditions in transponder units located in a plurality of zones, comprising a loop controller having a plurality of signal/power supply lines including a wiring pair, connected to the respective units; a module, including a microcontroller, connected in each of said transponder in said predetermined zones to said plurality of lines, said modules being capable of initiating communication of their conditions to said loop controller; a plurality of smoke detectors which draw relatively large current loads; and load shed means for sensing the alarm condition of a first of said detectors and reporting its condition to the loop controller while precluding the smoke detectors other than the first to initiate an alarm condition from drawing their normal operating current.

Other and further objects, advantages and features of the present invention will be understood by reference to the following specification in conjunction with the annexed drawings, wherein like parts have been given like numbers.

DESCRIPTION OF PREFERRED EMBODIMENTS

System and Common Module Circuitry

Figure 1:
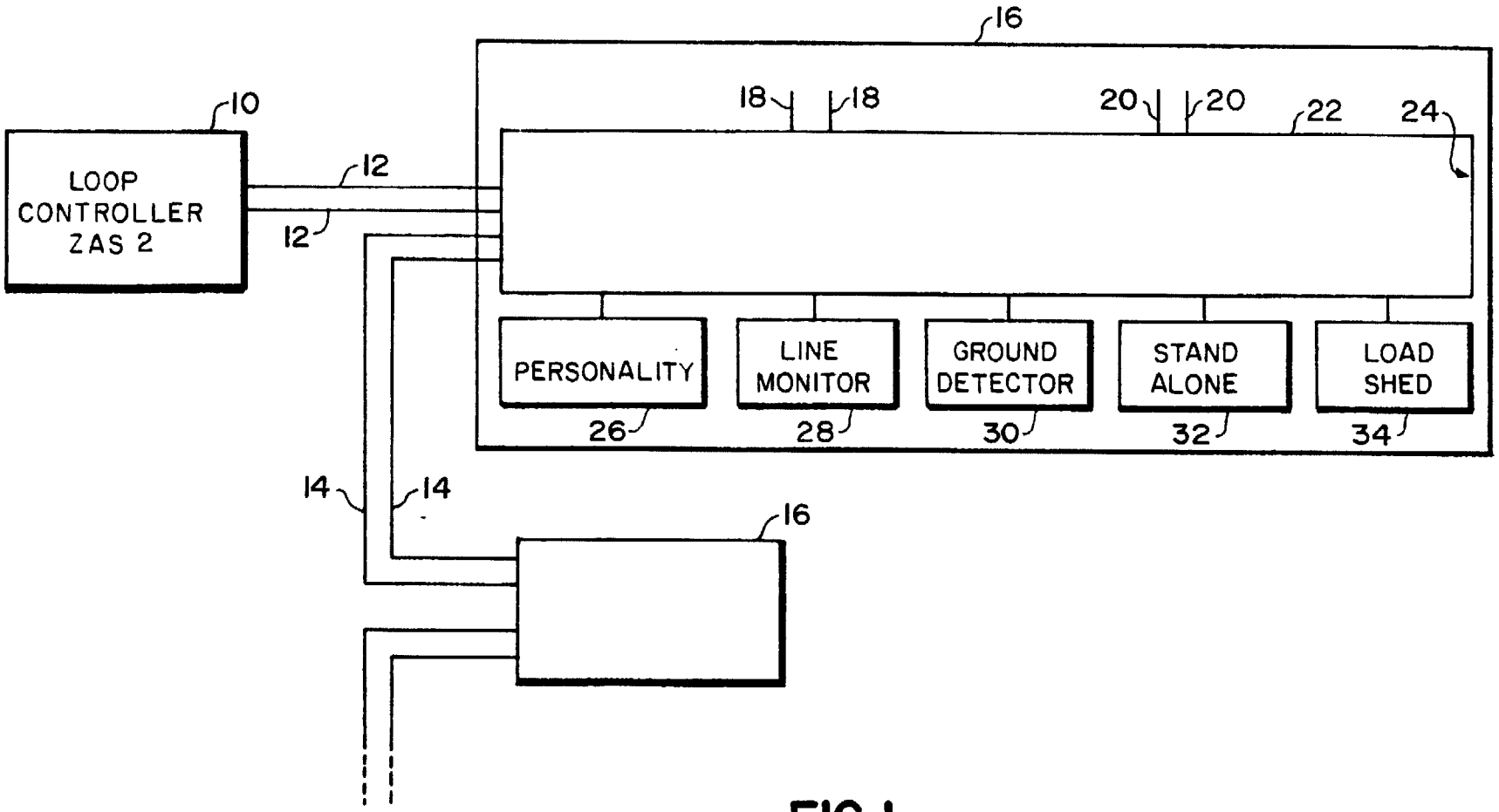
FIG. 1 is a functional block diagram which provides an simplified overview of the system in which the present invention is incorporated to constitute a unique group of transponder modules in such system.

Referring now to FIGS. 1–4 and more particularly for the moment to FIG. 1 of the drawing, there will be seen a simplified showing of the system context in which the present invention operates in order to accurately monitor and measure slave circuit impedance changes by incorporating a line voltage monitoring mechanism to be described.

In FIG. 1, the loop controller 10 is connected by multiple-wire outgoing and return cable 12 to a first transponder unit 16 which, in turn, is connected by a multiple-wire cable 14 to the next unit 16 and so on to other units.

Within the uppermost unit 16, there are seen a block designated 22 representing common components of a transponder module 24 whose inputs/outputs are represented by pairs of lines 18 and 20, which are supplied, typically with 24 v DC, and can be variously connected by the module to provide different modes of operation for the transponder 16. Also seen connected to the lower part of the common components 22 of the module 24 are the several inventive features forming parts of the module circuitry: a "personality" feature 26 which involves selective programming of a microcontroller, which forms the centerpiece of the module 24, such that various prescribed functions can be realized by the given module depending on the configuration code chosen. This personality feature is described and claimed in co-pending application, docket 100.0600 which is incorporated herein by reference.

The ground fault detector feature 30 is described and claimed in docket 100.0601. The stand alone feature 32 is described and claimed in docket 100.0603 and the line monitor feature 28 is described and claimed in docket 100.0602; the details of all of the preceding features being incorporated herein by reference to their respective patent applications already noted.

Figure 2:
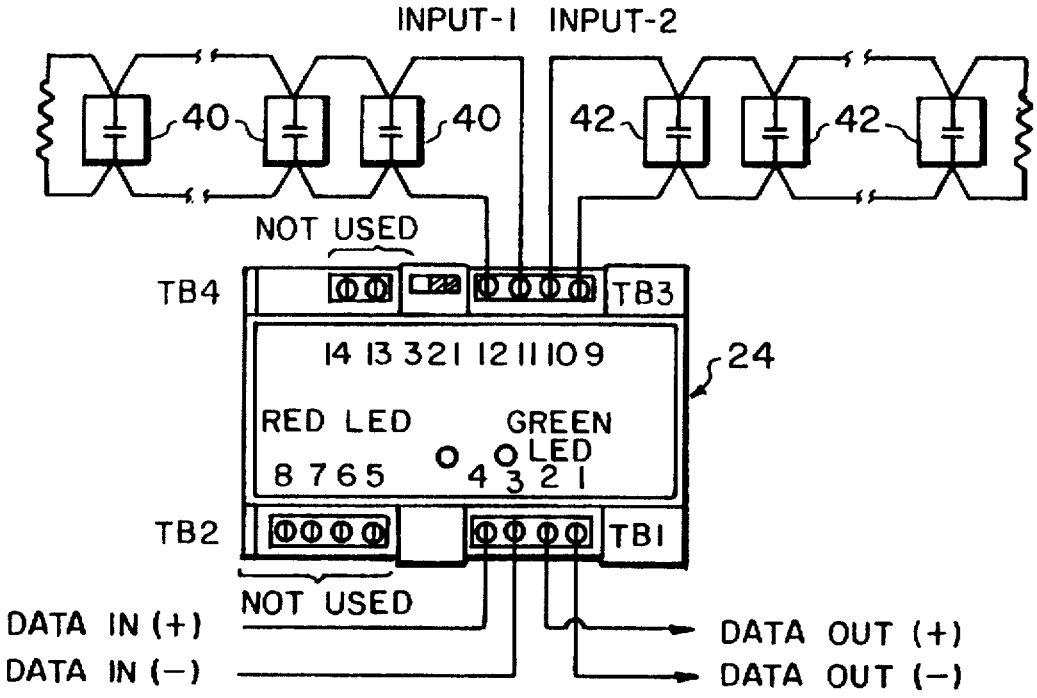
FIG. 2 is a block-schematic diagram of a class B dual input arrangement for a universal class A/B module incorporating the present invention.

Referring now to FIG. 2 of the drawing, there is depicted the module 24 which is a universal module and can be arranged, in this example, to operate class B, as a dual input module. Moreover, in this figure, connections of "data in" lines and "data out" lines are seen made to terminal blocks at the bottom of the modules, these lines corresponding, respectively, to lines 12 and 14 in FIG. 1. However, not seen in FIG. 1 are the particular class B input connections of FIG. 2, which are effectuated by the switch contacts 40, representing typical initiating devices, in input circuit 1 and, similarly, the contacts 42 in input circuit 2.

If a particular personality code, for example, personality code 1 is assigned to both of the input circuits seen in FIG. 2, this configures either one or the other or both circuits for class B normally open, involving dry contact initiating devices such as pull stations, heat detectors, etc. Consequently, when an input contact is closed an alarm signal is sent to the loop controller and the alarm condition is latched at the module 24. Further, it will be understood, particularly by reference to co-pending applications, docket 100.0600, that other personality codes assigned to the input circuits will provide different operations for water flow alarm switches, fans, dampers, doors, as well as other switches.

Figure 3:
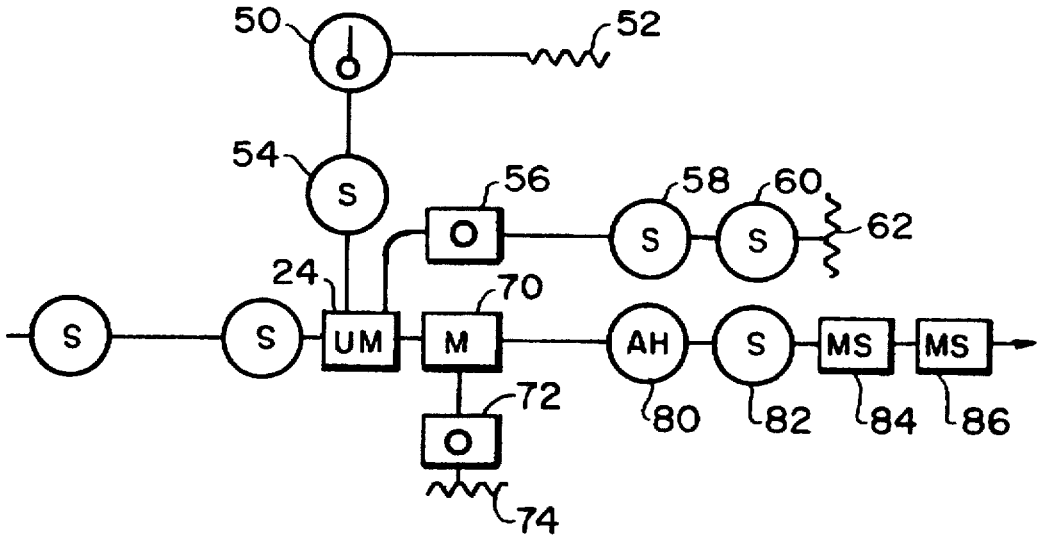
FIG. 3 is a block diagram of part of a system, and particularly illustrating a variety of devices in the form of smoke detectors and other devices connected to a universal transponder module at a given zone or station.

FIG. 3 illustrates the system where focus is on the selected circuitry or circuitry pathways extending from the universal module 24, as previously discussed, which is part of a transponder unit 16 located at a given zone or station. The module 24 is depicted in association with a variety of devices in, for example, input circuits. Such devices can be selected as a package with such universal module 24, or the module can be incorporated into an already existing system, that is, retrofitted to an older style system to bring it up-to-date. Thus, as shown in FIG. 3, two loops extend from the upper portion of the module. One loop includes a heat detector 50, an end of line resistor 52 and a conventional smoke detector 54. In the other loop there is a manual station 56, and two conventional smoke detectors 58, 60 with an end of line resistor 62 for that other loop.

Also connected to the universal module 24, in yet another loop, is a plurality of intelligent devices, including a monitor module 70 and associated therewith a manual station 72, and an end of loop resistor 74. Also extending, in a further loop, from the afore-noted monitor module 70 is an intelligent analog heat detector 80, an intelligent analog smoke detector 82, and analog manual stations 84 and 86.

FIGS. 4A through 4D and 4A' through 4C' are combined to form a schematic diagram of the module 24 in which the load shed feature of the present invention is embodied. To be considered first are the common aspects of such module 24. The module circuitry has at the lower right in FIG. 4C the connection from the loop controller to the "data in" lines 12 at the terminals designated TB 1-4, TB 1-3; as well as the connection to the next transponder unit at another location (see at the very bottom of the figure) by way of the "data out" lines 14 from terminals TB 1-2, TB 1-1.

It will be appreciated that data communication is accomplished over the aforesaid lines, as well as synchronous, large signal, transmission. As one example, interrupt (command) signals from the loop controller are transmitted to the module 24 over the "data in" lines (designated 12 in FIG. 1), three levels of interrupt command voltages being available; that is, zero volts, 9 volts, or 19 volts can be transmitted from loop controller 10.

The loop controller sends messages out by changing the line voltage between 0, 9, and 19 volts. The devices respond by drawing 9 ma of current during specific time periods. The basic time period of the protocol is given by:

$$T=64/32768=1.953 \text{ m sec.}$$

The loop controller uses a basic time period of ½ T (0.976 ms) because it has to sample the loop voltage and current in the middle of the data bits.

The start-up message, or interrupt mechanism, is specific and recognized by the module as follows: (Also, see FIG. 6).

1. The line voltage (across data lines 12) is initially at 19 volts for at least 2 time periods.
2. The line is held at 0 volts for 3 time periods.
3. The line goes to 9 volts for a 1 time period—this is the wake-up or interrupt bit and modules synchronize on this edge.
4. The line alternates between 9 and 19 volts for n T periods, where n is the number of data bits in the message.
5. The parity bit (even) follows the data bits.
6. The stop bit puts the line at 19 volts for 2 T periods, then the next message may be sent.

The voltages noted above are transmitted by way of internal connection 90 to a discriminator circuit 92 at the upper left in FIG. 4, whose output is connected from the uppermost node 94 of circuit 92, via inputs 13 and 42 to input ports of microcontroller 96. The discriminator circuit 92 also includes another output, taken at node 98, to a terminal 43 of the microcontroller. This microcontroller is selected to have an NEC microprocessor therein, as well as an EE PROM 126 manufactured by NEC.

As will be appreciated, the discriminator circuit insures that when 19 volts is received from the loop controller, such value is sufficient to exceed the upper threshold set by the circuit and hence inputs 13 and 42 are active, whereas when only 9 v appear, only input 42 is active.

It should be noted that the centerpiece or control device for the module 24 is the microcontroller 96. A number of input/output ports (PO.O, etc.) to which connecting terminals are provided, are shown on each side of the microcontroller, as well as connections made to the top and bottom thereof. It will be noted that a ground connection is made at the bottom of the microcontroller (Vss) and a bias connection (3.3 volts) at the top terminals 25 and 28, as well as a connection from terminal 25 to terminal 29 on the right side of the microcontroller.

A group of terminals 22–27 are provided for reset and for timing control of the microcontroller, the timing control connection being made to a timing circuit 100, provided with two clocks 102 and 104.

Another group of terminals are used for reference and average bias manual connections, such being designated terminals 30, 31 and 40, the 3.3 volt bias, terminal 30 to an input/output port at terminal 5; and terminals 31 and 40 to ground.

Groups of analog/digital ports are connected to the terminals designated 33, 37–39 of the microcontroller, the first being a vector input from circuit 112; the last three—being monitoring terminals, as will be explained hereafter.

A further group of terminals 18–21 are connected to input/output ports of microcontroller 96, which are, in turn, connected to relay cards for purposes to be explained. Another terminal on the right of the microcontroller is terminal 48, connected to "load shed" line 101 for purposes to be explained in connection with the load shed feature of the present invention.

Other groups of terminals, connected with output ports, appear on the left of the microcontroller. The group 53–55 is shown connected to circuitry at the lower portion of FIG. 4 and which will be explained. These output ports provide communication back to the loop controller, terminal 53 being connected by the connecting means 110 to the output of circuit 112 at the bottom of the figure and, hence, terminal 53 connects to an input port of the microcontroller; whereas 54 and 55 connect to the respective circuits 114 and 116 which are LED circuits, that is, circuits for illuminating the LED's at appropriate times. Further portions of the circuitry involve a peak detector 118 and a bias circuit 120 which, as can be seen, has the node 122 and supplies the bias of 3.3 volts for the microcontroller 96. A watchdog circuit 124 is seen immediately above the bias circuit 120, having a connection 121 to the microcontroller at terminal 62. Another group of four input/output ports is connected by respective terminals 57 through 60 to terminals of a 64 bit register 126. It will be seen that a connection from terminal 8 of the microcontroller is made to terminal 8 of register 126 for the purpose of providing a "strobe" to the register 126 in order to read the unit's identifying number stored in such register.

A reset circuit 130 furnishes a Reset+signal by way of the connection 132 to the clock circuit 100, the amplifier 133 in such circuit being biased from the 3.3 volts supply provided at node 122.

It will be noted that output terminals 18–21 of microcontroller 96 extend, by means of respective connections 150, 152, 154, and 156, to respective operational amplifiers, 160, 162, 164, and 166. The former two, that is, 160 and 162 are connected to respective ends of coil 168 and a trouble circuit 170 (which can be operated in class A, if desired), whereas, the operational amplifiers 164 and 166 are connected to opposite ends of relay coil 172, thus defining an alarm circuit 174.

Each of the relays in the trouble and alarm circuits is a double-pole, double throw, each involving four relay contacts, two being shown open and two being shown closed in each circuit.

The smoke detector 201 is seen connected across terminals TB 3-11 and TB 3-12; thence, by connecting means 203 and 205 to the respective points between pairs of alarm relay contacts 207 and 209. Alternative devices, such as bell or speaker 211 are similarly connected.

It will be understood that the specific type of device, i.e., bell, telephone, heat detector, manual pull station, etc., that is, selectively connected to the module is dependent on the assigned personality, or set of configuration bits, that is sent to the modules memory at the time of installation (and which set can be suitably changed at a later time, as already explained). For example, if the personality that is sent to the module is "2-wire smoke detector", then non-intelligent conventional-type 2-wire smoke detectors would be connected to terminals 11 and 12. Conversely, if the personality desired was to operate bells during alarm condition, the personality "Class B or Class A Signal Output" would be assigned and bells would be connected to terminals 11 and 12, and no 2-wire smoke detectors would be allowed on this module. Likewise, other selected personalities for the module would dictate other modes of operation for that portion of the circuitry in which the devices are selectively connected.

Load Shed Feature

This feature of the present invention is designed in particular to be operative in the context of a universal module as depicted in FIG. 4 herein. As has been described in co-pending application (docket 100.0602) a variety of specific "personalities" can be provided in a universal module, such as the other types depicted in the Figures of the co-pending application. It is the specific personality that possesses the ability to support conventional two-wire smoke detectors that forms the context for the present invention. In such context, however, there is a problem because conventional two-wire smoke detectors draw a substantial amount of current on the order of 20 milliamps. Accordingly, the load shed feature provides that when an alarm occurs for a particular smoke detector in a system where there are a number of conventional smoke detectors, the first smoke detector remains electrically connected, it annunciates its LED while the alarm is transmitted to the loop controller. However, what the present invention makes possible is that when a subsequent alarm occurs on another different module, the alarm is still transmitted to the controller, but all the other two-wire smoke detectors are electrically disconnected. In other words, the loads representing the detectors are shed or eliminated from drawing their normal operating current, thereby to conserve power. As a result an advantage of the present invention is that longer wire runs and smaller batteries are permitted, and first alarms can be identified.

The above cited objectives and advantages are realized by the present inventive feature which provides a simple but comprehensive hardware design combined with a more intricate software design such that all of the required functions are accomplished in an economic fashion.

Figure 4A:
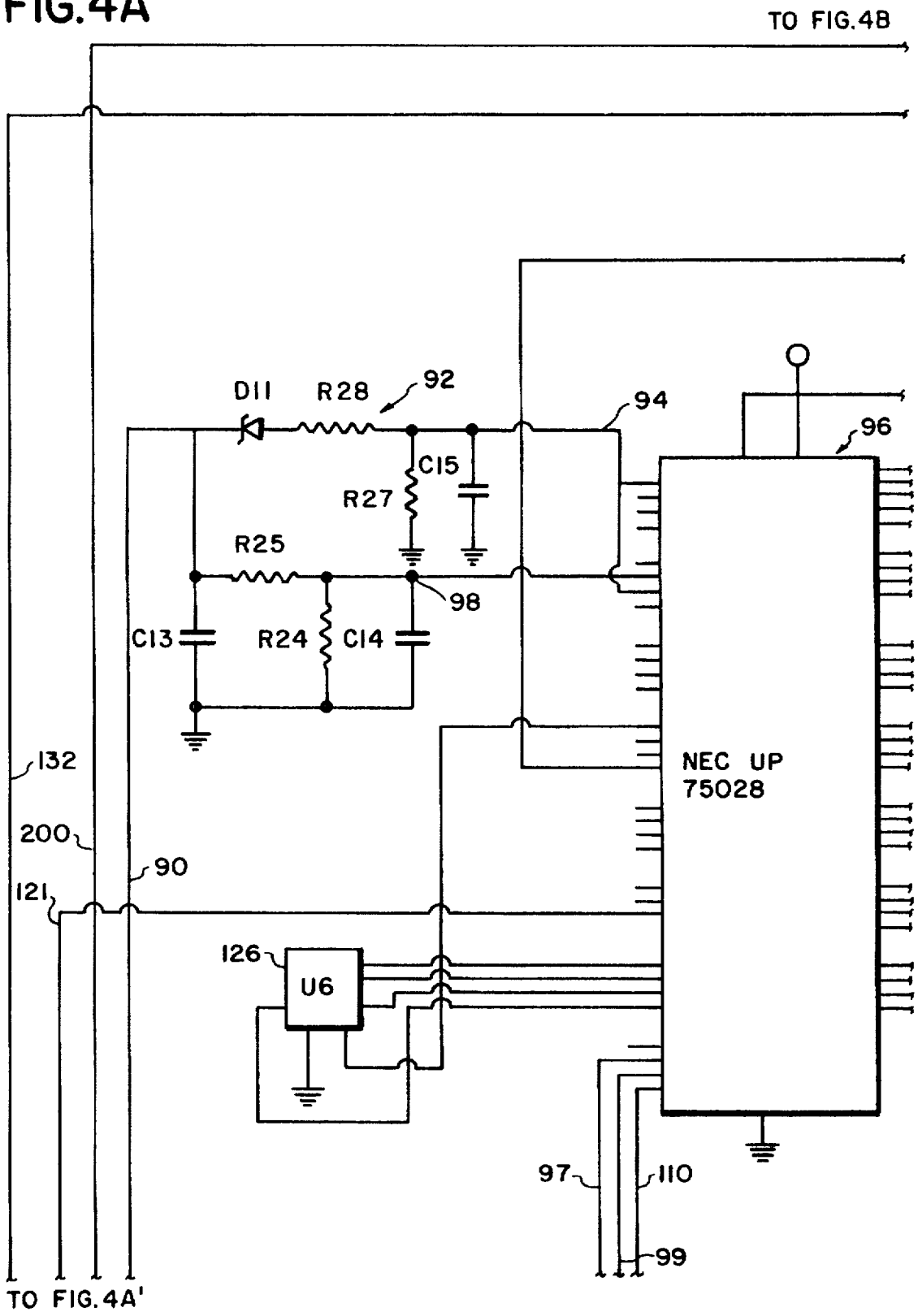
FIGS. 4*a*–4*d* and 4*a'*–4*c'* are schematic diagrams of a transponder, including a module.
Figure 4B:
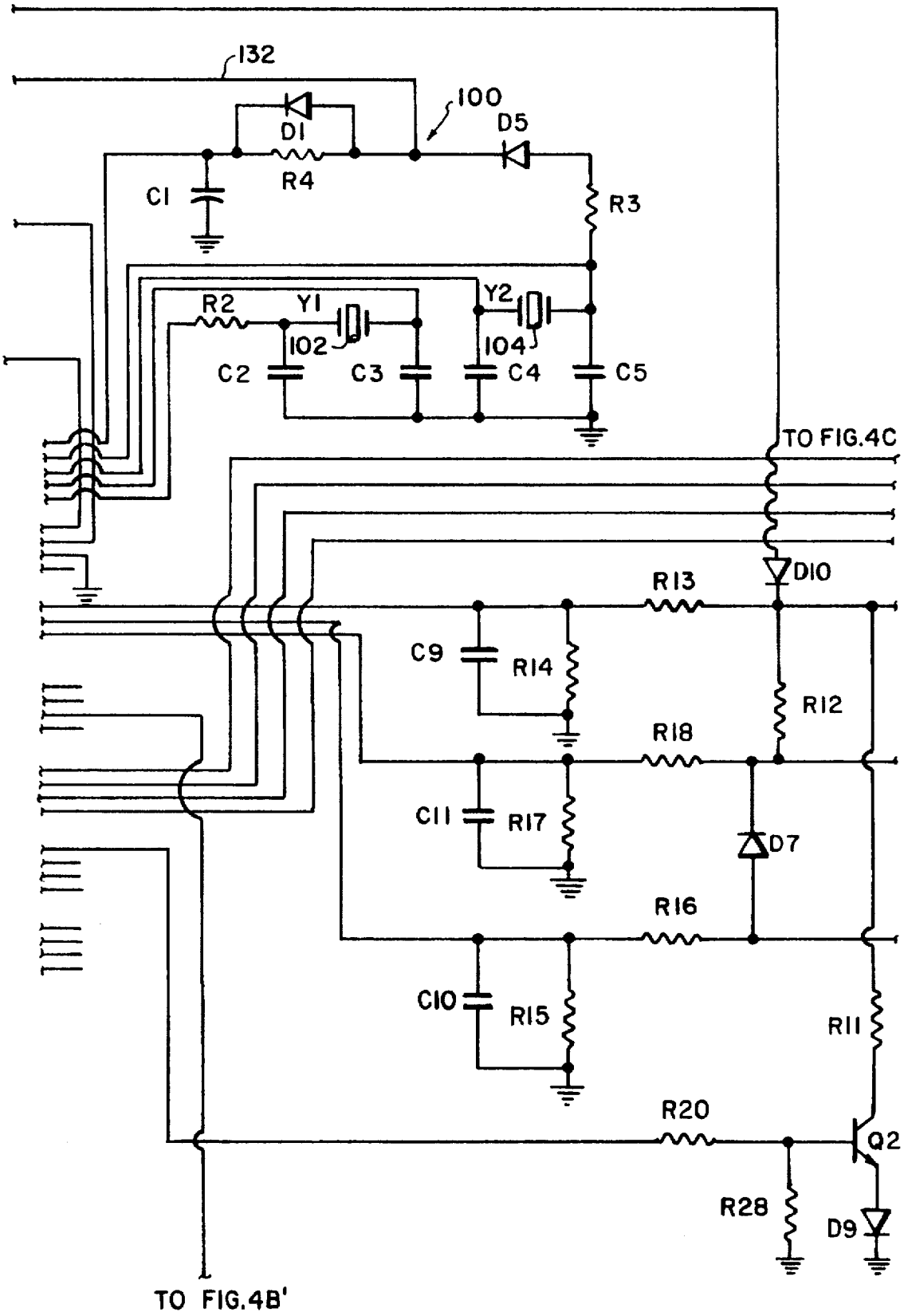
Figure 4C:
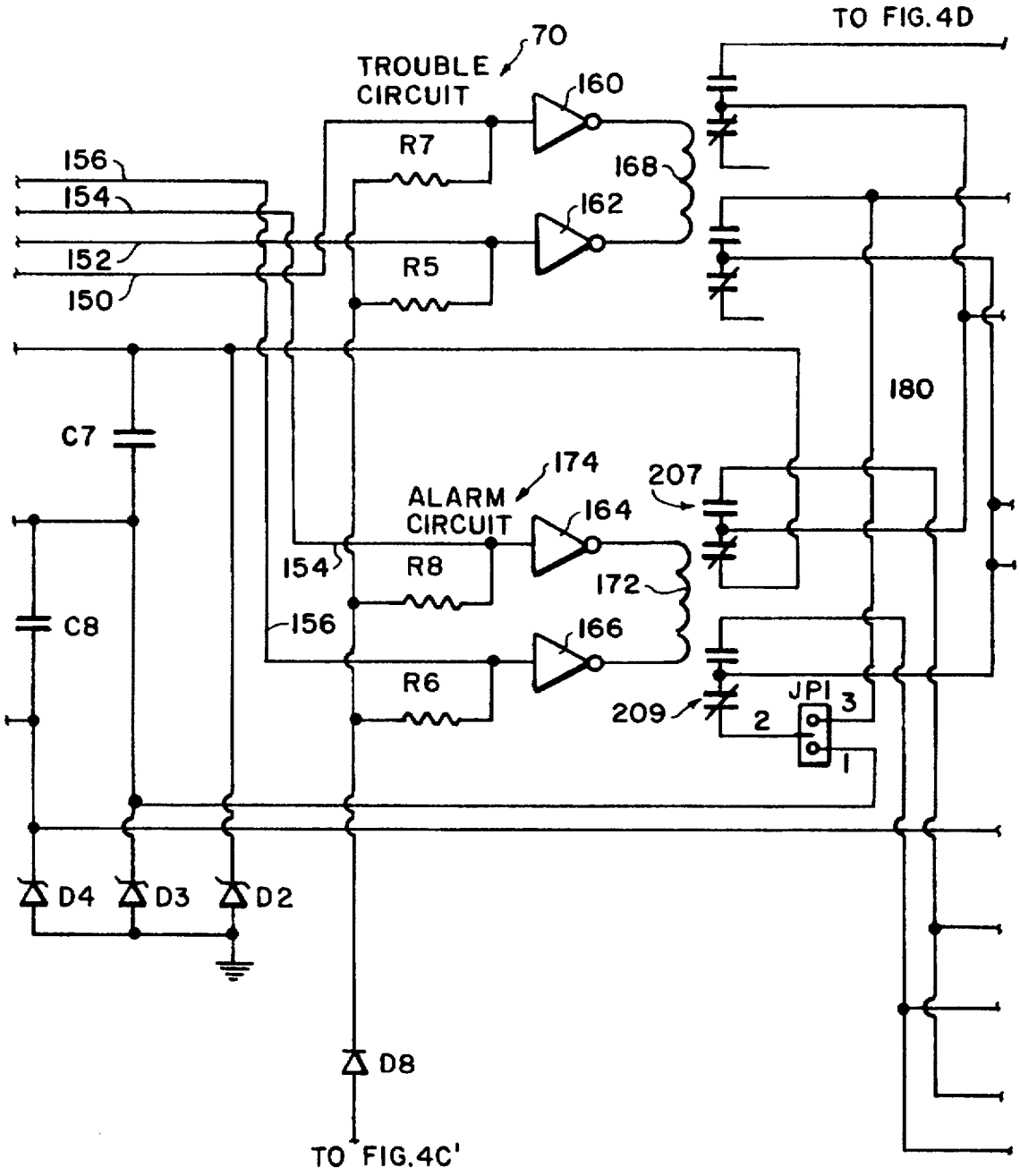
Figure 4D:
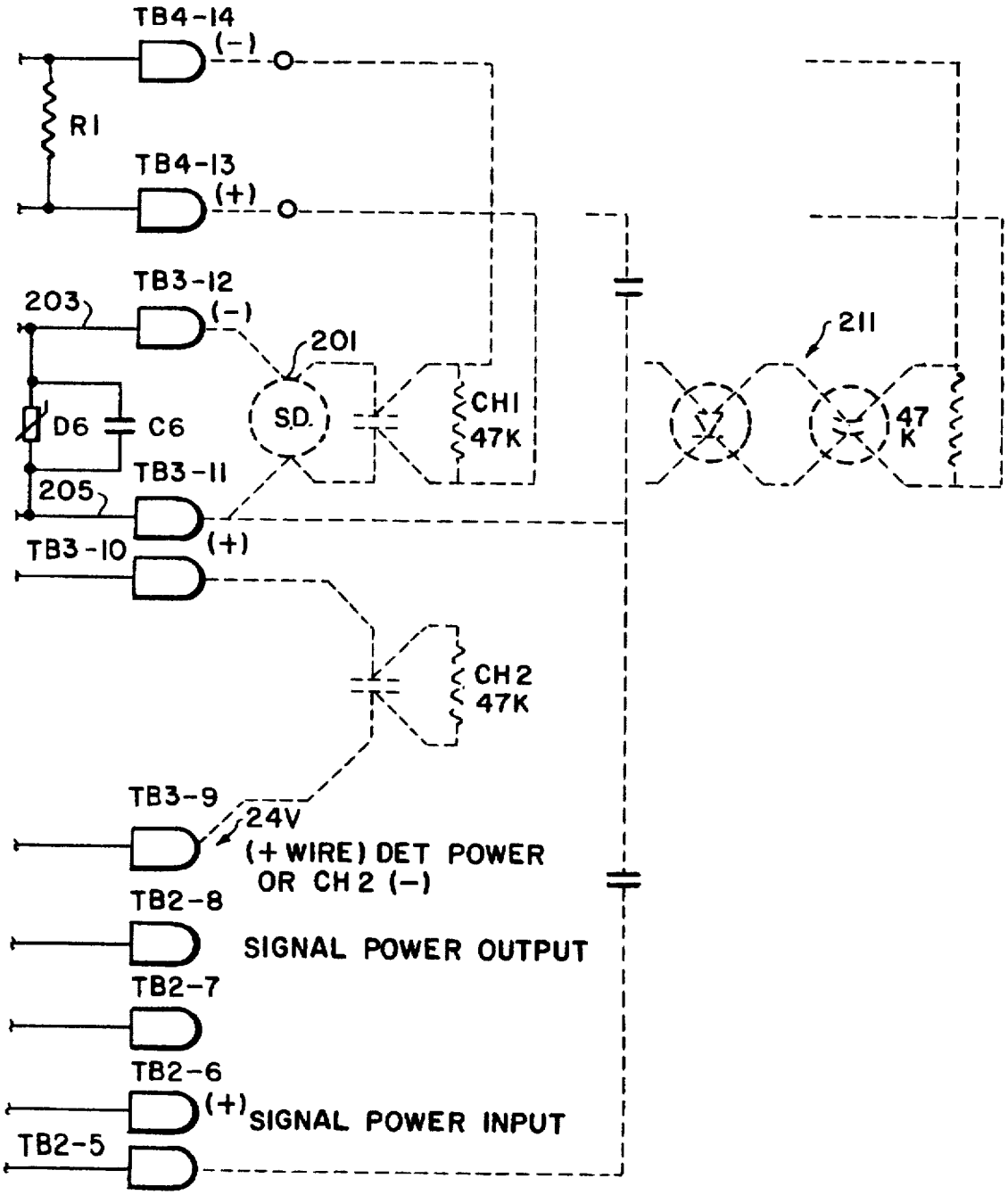
Figure 4A:
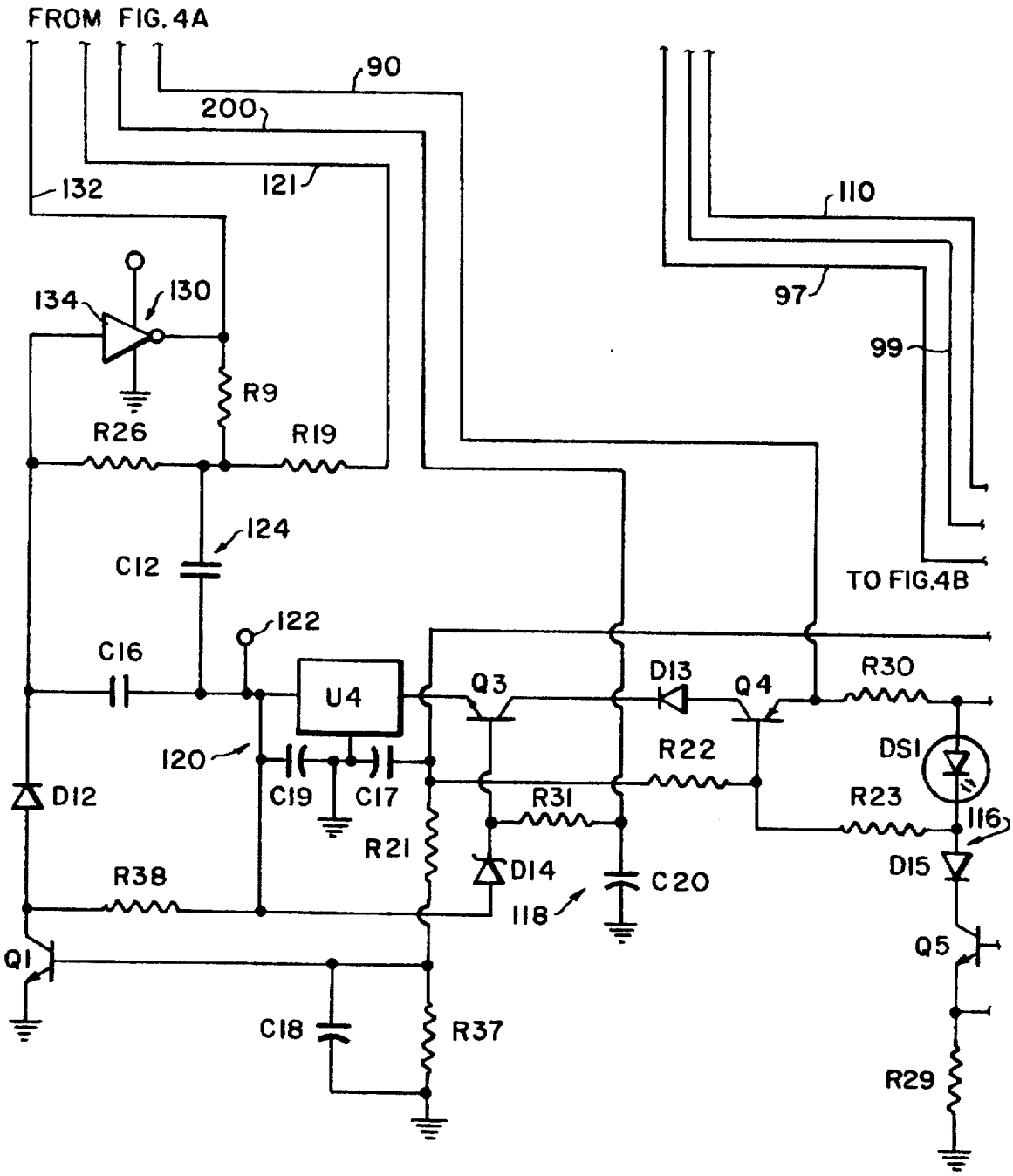
Figure 4B:
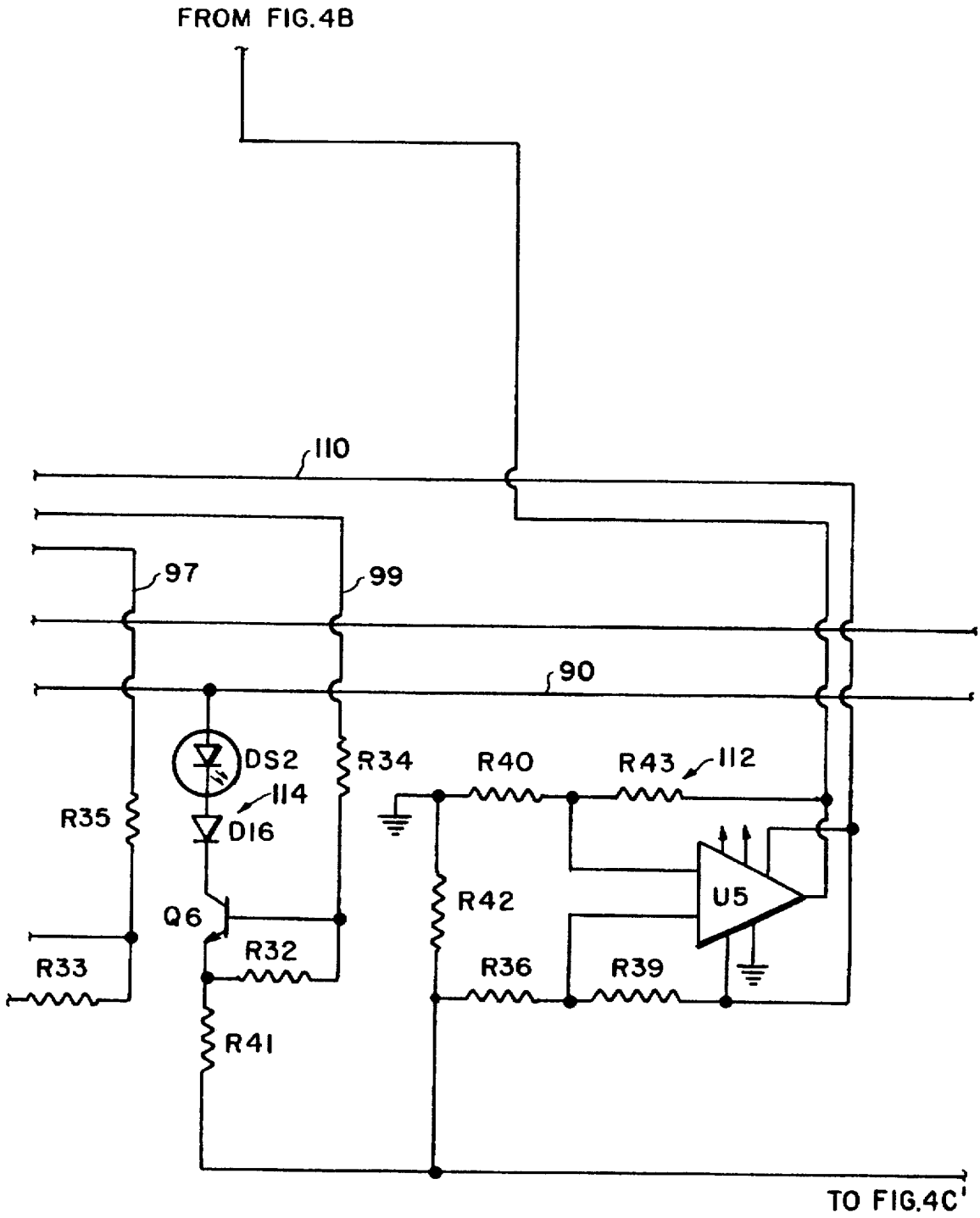
Figure 4C:
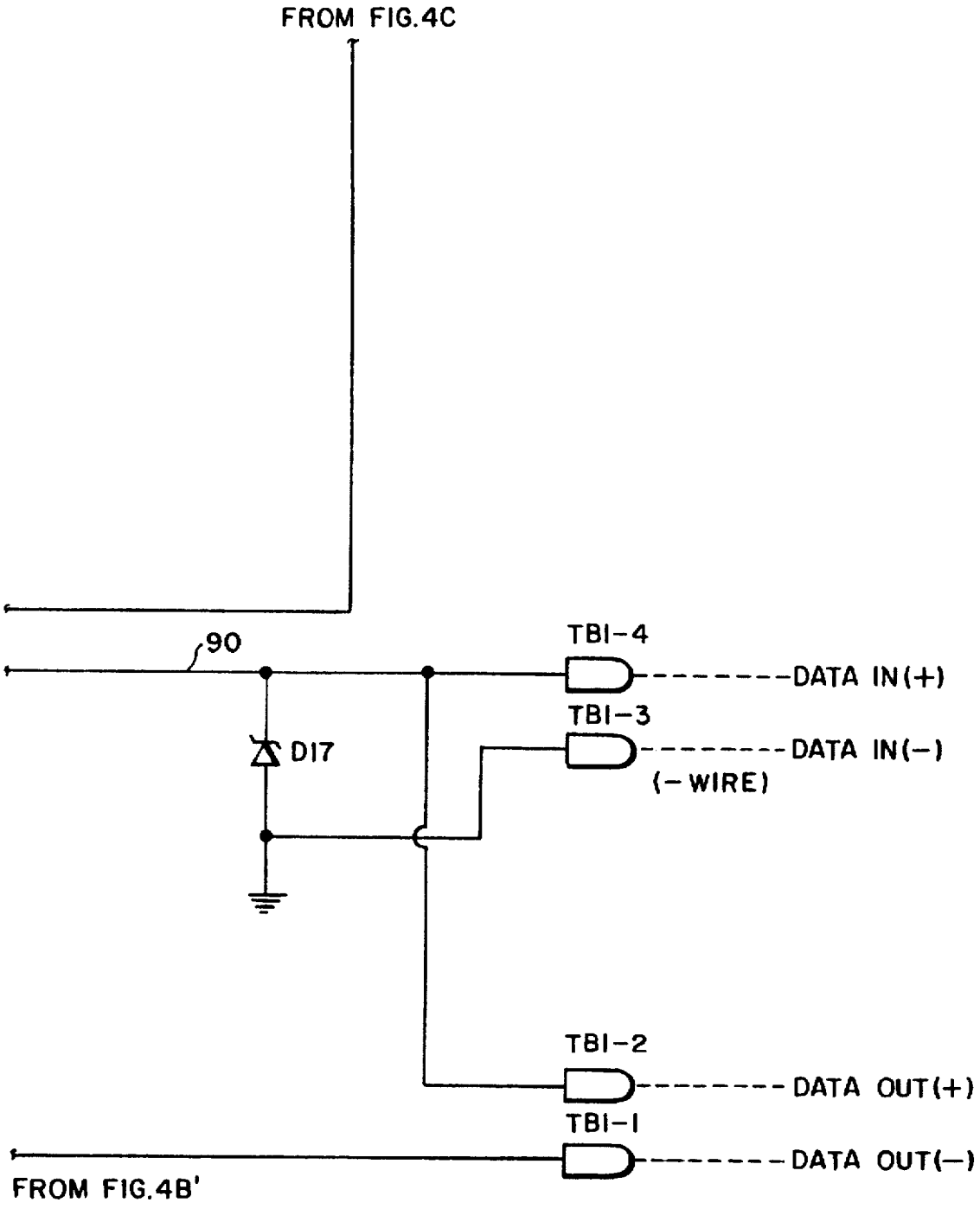
Figure 5:
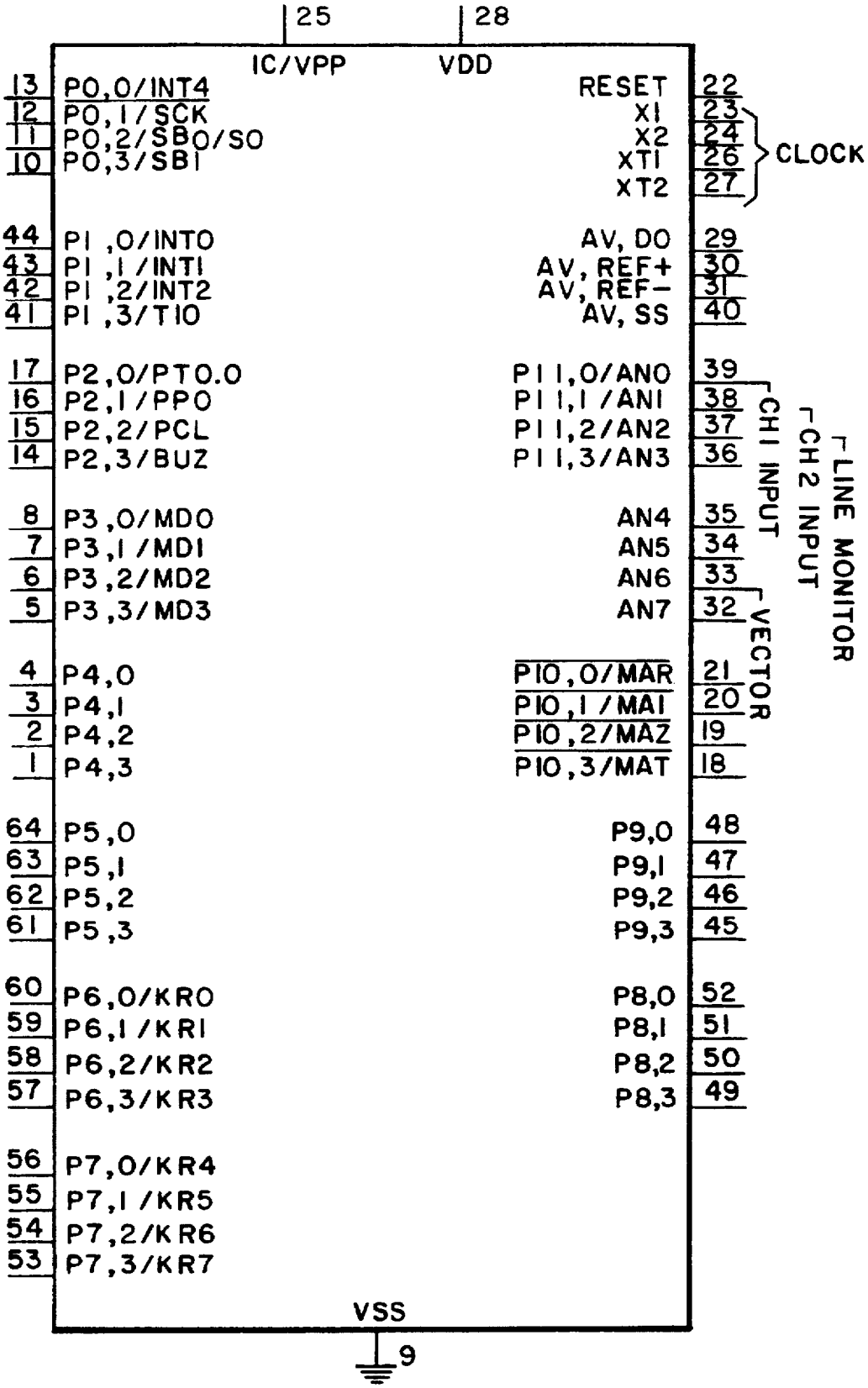
FIG. 5 is a magnified view of the microcontroller of the universal module of FIG. 4A.

Referring now in particular to FIG. 4D, there will be seen a conventional smoke detector (abbreviated SD) and designated 201, which SD may be connected to terminals TB 3-11 and TB 3-12 in a class B type operation, or, additionally, to that set of terminals+TB 4-13 and TB 4-14 in a class A operation.

Now a signal or flag is fed back to the loop controller over the data lines 12 so that the loop controller becomes aware of what is going on; that is, that an alarm is present. It will also know that this is the first alarm that has occurred on this type of universal module. As has already been explained, the loop controller knows how many modules there are and what kinds of modules they are. Accordingly, when the loop controller knows that it is a universal module, by reason of the specific hardware type embedded in its serial number, it can identify such and it knows that the load shed function is not to be performed since this is the first alarm, and it is desired that this SD 201 continue to operate.

However, let it be assumed that there is another universal module connected somewhere on the same pair of wires 12 to the loop controller and that the universal module has other two-wire conventional smoke detectors connected to it and one of those smoke detectors goes into alarm. When the second universal module sends a signal to the loop controller, effectively say, "I, too, am in alarm", the loop controller now knows that this is the second such detector in alarm.

It should be pointed out that the assumption has been made that only universal modules have the problem of high currents being drawn when a conventional smoke detector is in alarm. However, it will be apparent to those skilled in the art that other situations that likewise draw large amounts of current would also form the context in which the present invention could operate. That is, any situation where excessive current is expected to be drawn by multiple devices can be serviced.

The loop controller supplies a command signal, which is sent to the microprocessor 96 over the data lines 12 such that the microprocessor in the module will deactivate the load shed port (having an output at terminal 48), this terminal being connected to the base of transistor Q 2 over connection means 202.

It is the case at the universal module 24 being discussed that it is configured to have a smoke detector "personality"; that is, it is set up to be associated with a two-wire conventional smoke detector. This means in such situation that transistor Q 2 is always supplied over the connection 202 from the load shed terminal 48—at which appears a positive digital signal of 3.3 volts which results in having the transistor normally conducting. However, once the first conventional smoke detector in the system has reported a smoke condition, that is, the alarm has been communicated, the loop controller signals the data input at the discriminator 92 to the microprocessor 96 of this condition or status. This results in changing the digital output at terminal 48 to zero with the consequence that transistor Q 2 is thereupon turned off. As a result, the connection from the output of transistor Q 2, that is, the connection by means 182 through the contact circuit and to the smoke detector 201 is such that continuous operation of other smoke detectors is precluded.

An important novel element about the load shed feature is that the system will not load shed the first conventional smoke detector that is in alarm, that is, the load shed operation will occur but only on a subsequent module with smoke detector. The reason is because the conventional smoke detectors allow you to view the alarm condition by reference to the lighted LED on such smoke detectors. It must be remembered that the universal module is capable of having multiple smoke detectors connected to it. For example, it can have up to twenty smoke detectors involved, wired and paralleled to the one universal module seen in FIG. 4.

Suppose, for example, however, these twenty smoke detectors are up in a atrium or other hard to reach place in a building, for instance, and you had a false or unwanted alarm such that one of the smoke detectors would be the cause of this false alarm. It would then be important to identify the location of that one smoke detector. Suppose that a bug crawled into one of the smoke detectors and caused a false alarm. One would then want to identify which of the twenty smoke detectors had the bug in it. Accordingly, if there is just a single incident, we don't want to do the load shed function because we want the impedance to be measured with respect to the appropriate voltage, that is, the smoke detector voltage is to be held constant at 22 v so that the detector is capable of operating to light up the LED, and the actual LED current is through that same set of wires. We have to keep the impedance low.

The invention having been thus described with particular reference to the preferred forms thereof, it will be obvious that various changes and modifications may be made therein without departing from the spirit and scope of the invention as defined in the appended claims.

We claim:

1. An alarm system for detecting and warning of the presence of alarm and trouble conditions in transponders located in a plurality of zones, comprising:

a loop controller having a plurality of input signal and power supply lines connected to the respective transponder units;

a plurality of initiating and indicating devices in a respective plurality of circuits;

a module, including a microcontroller, connected in each of said transponder units to said plurality of input lines and to said plurality of circuits, said module being capable of initiating communication of the conditions of said circuits to said loop controller; and a plurality of smoke detectors, which are connected in said circuits and to respective modules; and means for sensing the alarm conditions of said smoke detectors and reporting their conditions to the loop controllers; and load shed means for permitting, in the first instance, a first of said smoke detectors to draw operating current, but, thereafter, precluding the others of said plurality of smoke detectors from drawing their operating current.

2. An alarm system defined in claim 1, in which said microcontroller has a plurality of connection means connected to a respective plurality of terminals associated with ports of said microcontroller including a load shed terminal; one of said ports receiving command signals from said loop controller to deactivate said load shed terminal on the microcontroller for preventing smoke detectors, other than the first to draw operating current, from drawing operating current.

3. An alarm system defined in claim 2, in which at least some of said terminals have outgoing connections to said devices in said respective circuits, said microcontroller having terminals which monitor or sense the condition of said devices.

4. An alarm system defined in claim 3, in which a three terminal control device is connected by said load shed connecting means to said microcontroller, the state of said three terminal device controlling the operating conditions of the smoke detectors other than the first one.

* * * * *